United States Patent [19]

Schillinger

[11] 4,256,438

[45] Mar. 17, 1981

[54] METHOD AND APPARATUS FOR SIMULTANEOUS NOISE DAMPING ON INTAKE AND PRESSURE SIDES OF FLUID PUMPS

[75] Inventor: Rainer Schillinger, Stuttgart, Fed. Rep. of Germany

[73] Assignee: Robert Bosch GmbH, Stuttgart, Fed. Rep. of Germany

[21] Appl. No.: 36,105

[22] Filed: May 4, 1979

[30] Foreign Application Priority Data

May 31, 1978 [DE] Fed. Rep. of Germany ..... 2823768

[51] Int. Cl.[3] ..... F04B 11/00

[52] U.S. Cl. ..... 417/53; 417/542

[58] Field of Search ..... 417/53, 540–544

[56] References Cited

U.S. PATENT DOCUMENTS

| | | | |
|---|---|---|---|
| 2,276,568 | 3/1942 | Erickson | 417/540 X |
| 2,811,931 | 11/1957 | Everett | 417/540 X |
| 2,951,450 | 9/1960 | Fisher | 417/542 X |
| 3,192,864 | 7/1965 | Notte | 417/540 |
| 4,185,455 | 1/1980 | Savkar | 417/540 X |

*Primary Examiner*—Philip R. Coe

*Attorney, Agent, or Firm*—Edwin E. Greigg

[57] ABSTRACT

A method and apparatus are proposed for the simultaneous damping of noise on the intake and pressure sides of fluid pumps, particularly fuel supply pumps. The method comprises the diverting of peaks of variation in the supply medium from the intake and pressure sides and then bringing them together, in a common region, into operative contact under the control of a diaphragm. The peaks of variation are furthermore adjusted in such a manner, by means of the length of the connection lines surrounding them, for example, that a phase displacement of 180° is produced in the variations for the purpose of mutual compensation of the pressure variations on both sides which cause the generation of noise.

4 Claims, 2 Drawing Figures

METHOD AND APPARATUS FOR SIMULTANEOUS NOISE DAMPING ON INTAKE AND PRESSURE SIDES OF FLUID PUMPS

BACKGROUND OF THE INVENTION

The invention relates to a method and an apparatus for the simultaneous damping of noise on the intake and pressure sides of fluid pumps as described in the claims appended hereto.

If fluid supply is accomplished with the aid of a fluid pump which is embodied as a piston pump or one of a similar type, for example, a positive-displacement pump, then the medium to be supplied is taken in, compressed, and expelled, with this process being repeated in rapid sequence. When a roller cell pump is used as the positive-displacement pump for the purpose of fuel supply, as is often the case, the intake, compression and expulsion process is repeated as often as there are discrete chamber volumes of the supply medium; that is, in the case of a five-celled roller cell pump, five times. Each of these pumping processes is associated with a brief drop in the intake underpressure and with an increase of the supply pressure. The pressure variations in the supplied medium which thus result, which form both on the intake and the pressure side of the pump and whose frequency is determined by the rotary speed of the pump, spread out in the form of sound waves (primarily those carried through solids) and thus, under certain circumstances, result in a high noise level in the pump.

If the noise-generating pump is a fuel supply pump in a motor vehicle or other mobile unit, then the most important cause of noise is that the pressure variations on the intake and pressure sides thereof are transmitted to the vehicle body (on the pressure side) and to the fuel tank (on the intake side).

The need thus arises for noise damping systems which damp pressure variations arising on the intake and pressure sides as close as possible to the point of origin and neutralize energy being released without restricting the functioning of the pump, and in particular accomplishing this at minimal expense.

OBJECT AND SUMMARY OF THE INVENTION

The method and the apparatus in accordance with the invention have the advantage over the prior art that, as a result of the mutual compensation, sound wave variations carried through solids are compensated for independently of the rotary speed and the size of the fluid pump, which in the exemplary embodiment is the fuel supply pump in a motor vehicle.

If the fuel supply pump is used in a fuel injection system, then it is possible to even out the absolute pressure difference between the intake side and the pressure side thereof by means of a spring which acts upon the separation diaphragm, for in fuel injection systems the operational pressure should be maintained constant. The compensation apparatus is therefore independent of the absolute pressure difference and reacts solely to the pressure variations on both sides, whose amplitude is approximately the same on the intake and on the pressure sides.

The invention will be better understood as well as further objects and advantages thereof become more apparent from the ensuing detailed description of a preferred embodiment taken in conjunction with the drawings.

DESCRIPTION OF THE PREFERRED EMBODIMENT

Figure 1:
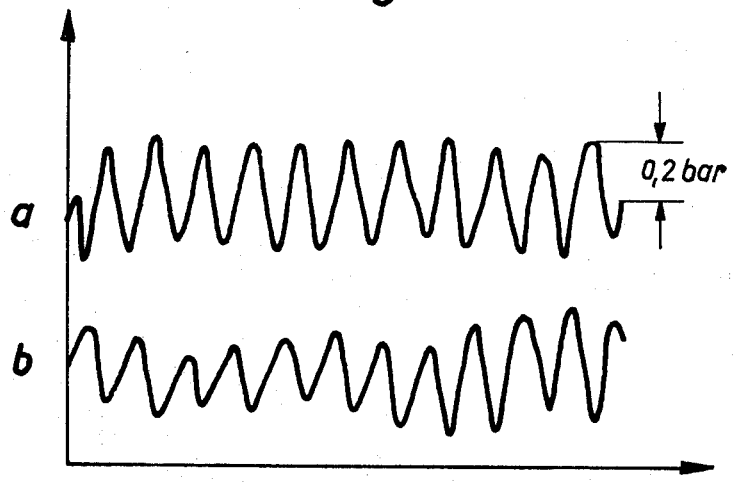
FIG. 1, in the form of a diaphragm, shows at (a) the course of the pressure variations on the pressure side at an absolute pressure of 1 bar and at (b) the course of the pressure variations on the intake side at an absolute pressure of ca. 6 bar.

In accordance with FIG. 1, the pressure variations arising in a fluid pump and in the preferred embodiment of a fuel supply pump are periodic, and their frequency corresponds to the frequency with which the pump cells open and close at the intake and pressure sides. It may be seen from FIG. 1 that the amplitudes of the pressure variations, that is, the deviations from a stationary average pressure which form on the intake and pressure sides, are approximately equal in size and may be, for example, $\pm 0.2$ in width on either side.

Figure 2:
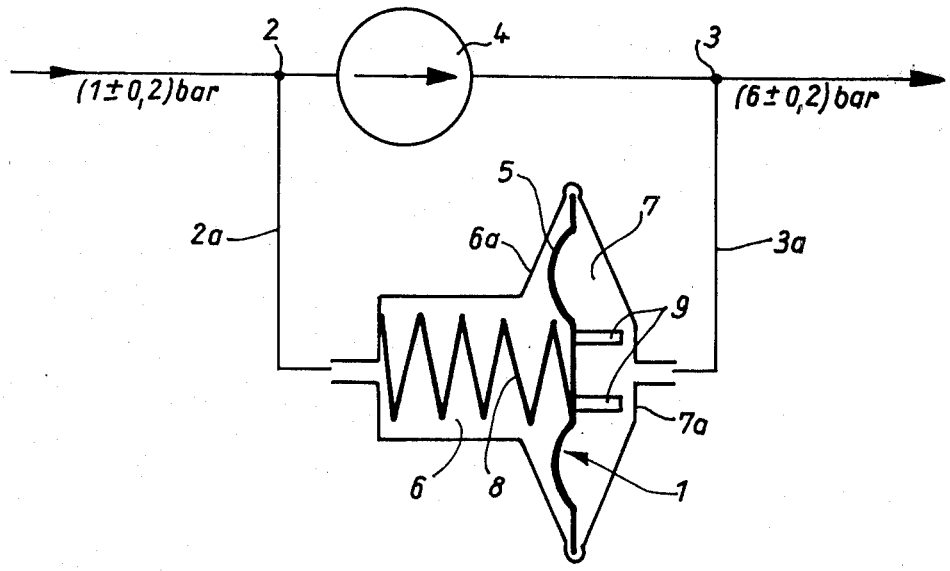
FIG. 2 is the schematic representation of an apparatus for compensating for pressure variations in which the two variations are compensated for mutually by means of a diaphragm located between the intake and the pressure side.

The invention is based on the experimentally derived recognition that a certain phase displacement exists, or can be induced, between the variations on the intake side of a pump and those on the pressure side thereof. This may also be seen from a comparison of the curves (a) and (b) in FIG. 1. The basic concept of the present invention thus resides in that the courses of the two dynamic pressure variations are made subject to a mutual influence, so that they balance each other out. The region of mutual influence is preferably laminar and separated by a diaphragm; this region of mutual influence is shown in FIG. 2 as a compensation apparatus 1.

In order to provide mutual compensation of the intake and pressure side variation amplitudes, it is necessary that their mutual phase displacement amount at least approximately to 180°, as may be seen from the course taken by the curves for the intake side and the pressure side in FIGS. 1*a* and 1*b*, respectively.

In order to provide mutual compensation, the effective contact between the intake side 2 and the pressure side 3 of the fuel supply pump 4 takes place via a separation diaphragm of the compensation apparatus 1.

In the exemplary embodiment shown in the figures, the intake side 2 and the pressure side 3 can be connected via connection lines 2*a* and 3*a*, respectively, with the working chambers 6 and 7 of the compensation apparatus 1, the working chambers of which are separated by the diaphragm 5. In this arrangement, the different average values of the two variations (1 bar on the intake side and 6 bar on the pressure side) can be balanced out by means of a compression spring 8, which supports the diaphragm 5 from the intake side and holds it, counter to the elevated average pressure on the pressure side, in an approximately neutral central position. In order that the diaphragm 5 is not excessively deformed by the action of the pressure spring 8 when the fuel supply pump 4 is not in operation, stops 9 can also be provided which in the resting state of the pump contact the rear wall 7*a* of the working chamber 7 and hold the diaphragm spaced apart from the rear wall. The compensation apparatus 1 may be embodied in the form of a housing having walls *7a* and *6a* which taper or converge toward the rim area. The diaphragm 5 is squeezed tightly between these walls *7a* and *6a*. It is essential that the phase displacement of the variations arising on the intake side and on the pressure side of the pump be influenced in such a manner, by means of an appropriate selection of the lengths of the connection lines or by other appropriate means, that the phase displacement amounts to 180° at the compensation apparatus 1, so that the mutual balancing out of the pressure variations is possible.

It will be appreciated that the disposition of the compensation apparatus within the surrouning housing of the fluid pump (that is, in the exemplary embodiment, the electric fuel supply pump 4) is also part of the inventive concept. In this case, the walls *7a, 6a* of the compensation apparatus 1 may be omitted and the diaphragm may be disposed indirectly on some part of the fuel supply pump 4 which causes a separation of a particular intake side from a particular pressure side in the interior of the pump. The precondition is that the approximately 180° phase displacement of the variation amplitudes required for compensation purposes be attained at this point in the pump interior by suitable means, or be present there; delay systems can also be introduced in order to obtain the phase displacement.

If the diaphragm is made of a suitable stiff material which however exhibits sufficient elasticity to compensate for the effective variations, then the supporting compression spring 8 as well may be omitted.

The foregoing relates to a preferred embodiment of the invention, it being understood that other embodiments and variants thereof are possible within the spirit and scope of the invention, the latter being defined by the appended claims.

What is claimed and desired to be secured by Letters Patent of the United States is:

1. A method for the simultaneous damping of noise in fluid pumps, such as fuel supply pumps, including a housing having a tapered shaped chamber converging toward a rim area of a diaphragm, an electromotor and a plurality of driven pumping stages disposed within said housing comprising the steps of:

diverting the peaks of variation in the supply medium on the intake and pressure sides of said diaphragm in said housing of the fluid pump, bringing said peaks of variation in the supply medium together into an effective contact in a common region separated by said diaphragm whereby the peaks of variation are adjusted in such a manner that a phase displacement of 180° is produced in the variations for the purpose of mutual compensation of the pressure variations on both intake and pressure sides which cause the generation of noise, performing an initial stressing in order to balance out the different average values of the two pressure variations in the common contact region, and varying the length of the variation peaks in order to attain a mutual phase displacement of 180° in the common contact region.

2. An apparatus for the simultaneous damping of noise on the intake and pressure sides of fluid pumps such as fuel supply pumps including a housing, an electromotor and a plurality of rotary driven pumping stages disposed within said housing comprising, in combination:

a housing having a separation diaphragm therein and having walls forming a tapered-shaped chamber converging toward a rim area of the diaphragm, said diaphragm being disposed within said housing to form a compensation apparatus, and being disposed in a separation plane between the intake side and the pressure side of said fluid pump, said diaphragm being arranged in mutual operational contact at least with the variation peaks diverted from said intake side and the pressure side, connection lines for communicating said housing with the intake side and the pressure side of said fluid pump, said connection lines having dimensions such that, at least one of the length, thickness and guidance of the variation peaks is accordingly dimensioned whereby the variation peaks from the intake and the pressure sides exhibit a phase displacement of 180° at said diaphragm.

3. An apparatus in accordance with claim 2, including a spring for initially stressing said diaphragm in the direction of the pressure side in order to balance out the different average pressure values between the intake and the pressure sides.

4. An apparatus in accordance with claim 3, wherein said diaphragm is provided with a stop for supporting said diaphragm on said housing of said compensation apparatus counter to the pressure of said initially stressing spring.

* * * * *